US009850093B2

(12) United States Patent
DePaola et al.

(10) Patent No.: US 9,850,093 B2
(45) Date of Patent: Dec. 26, 2017

(54) SYSTEM AND METHOD FOR CONTROLLING ELEVATOR SYSTEM ACCESS

(75) Inventors: Peter DePaola, South Windsor, CT (US); Matthew Joyce, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 491 days.

(21) Appl. No.: 14/403,202

(22) PCT Filed: Jun. 22, 2012

(86) PCT No.: PCT/US2012/043696
§ 371 (c)(1),
(2), (4) Date: Nov. 24, 2014

(87) PCT Pub. No.: WO2013/191705
PCT Pub. Date: Dec. 27, 2013

(65) Prior Publication Data
US 2016/0009525 A1 Jan. 14, 2016

(51) Int. Cl.
*B66B 1/20* (2006.01)
*B66B 1/46* (2006.01)
*G07C 9/00* (2006.01)

(52) U.S. Cl.
CPC ..... *B66B 1/468* (2013.01); *G07C 9/00007* (2013.01); *G07C 9/00896* (2013.01);
(Continued)

(58) Field of Classification Search
CPC ..... B66B 1/468; B66B 2201/4615; B66B 2201/4653; B66B 2201/4676; G07C 9/00007; G07C 9/00896
(Continued)

(56) References Cited

U.S. PATENT DOCUMENTS 4,431,086 A * 2/1984 Moser ..... B66B 1/468 187/380
5,749,443 A * 5/1998 Romao ..... B66B 1/468 187/384
(Continued)

FOREIGN PATENT DOCUMENTS

CN 101910042 12/2010
JP 2005280882 10/2005
(Continued)

OTHER PUBLICATIONS

International Search Report and Written Opinion for International application No. PCT/US2012/043696 dated Feb. 14, 2013.
(Continued)

*Primary Examiner* — Anthony Salata
(74) *Attorney, Agent, or Firm* — Carlson, Gaskey & Olds

(57) ABSTRACT

An exemplary elevator system includes at least one elevator car. An access controller is configured to provide an access credential to a portable wireless communication device responsive to a request from that device indicating a desire for at least access to the elevator system. The access credential at least temporarily indicates that the desired access should be granted. A credential receiver is configured to obtain the provided access credential from the portable wireless communication device. An entry device allows the desired access responsive to the credential receiver obtaining the access credential.

24 Claims, 2 Drawing Sheets

(52) U.S. Cl.
CPC ..... *B66B 2201/4615* (2013.01); *B66B 2201/4653* (2013.01); *B66B 2201/4676* (2013.01)

(58) Field of Classification Search
USPC ..... 187/247, 380–389, 391, 392, 396; 713/193, 194; 726/2, 3, 26–30; 711/163, 711/164; 235/375, 380
See application file for complete search history.

(56) References Cited

U.S. PATENT DOCUMENTS 6,202,799 B1 3/2001 Drop
6,397,976 B1 6/2002 Hale et al.
6,425,460 B2 * 7/2002 Schuster ..... B66B 1/34 187/247
6,707,374 B1 * 3/2004 Zaharia ..... B66B 1/468 187/392
6,868,945 B2 3/2005 Schuster et al.
6,986,408 B2 * 1/2006 Takeuchi ..... B66B 1/14 187/247
7,205,882 B2 4/2007 Libin
7,347,303 B2 * 3/2008 Kontturi ..... B66B 1/468 187/380
7,353,915 B2 4/2008 Zaharia et al.
7,377,364 B2 5/2008 Tyni et al.
7,500,544 B2 * 3/2009 Hakala ..... B66B 1/463 187/382
7,793,762 B2 9/2010 Zaharia et al.
7,882,939 B2 2/2011 Nakamura
8,047,333 B2 * 11/2011 Finschi ..... B66B 1/468 187/382
8,061,485 B2 * 11/2011 Finschi ..... B66B 1/468 187/384
8,070,061 B2 * 12/2011 Habraken ..... G06Q 20/327 235/375
8,348,021 B2 1/2013 Finschi
8,464,840 B2 * 6/2013 Flynn ..... B66B 1/468 187/384
8,485,317 B2 * 7/2013 Gerstenkorn ..... B66B 1/468 187/247
8,490,754 B2 * 7/2013 Amano ..... B66B 1/2458 187/384
8,689,013 B2 * 4/2014 Habraken ..... G06F 21/32 713/193
8,770,350 B2 * 7/2014 Wilke ..... B66B 1/468 187/247
8,813,917 B2 * 8/2014 Salmikuukka ..... B66B 1/468 187/247
8,944,219 B2 * 2/2015 Gerstenkorn ..... B66B 1/468 187/384
9,108,824 B2 * 8/2015 Hughes ..... B66B 1/34
9,242,834 B2 * 1/2016 Terry ..... B66B 1/468
2006/0144644 A1 7/2006 Chiba
2007/0026802 A1 2/2007 Gerstenkorn
2007/0151809 A1 7/2007 Tyni et al.
2008/0236956 A1 10/2008 Finschi
2010/0222031 A1 9/2010 Carolan et al.
2010/0315208 A1 12/2010 Takeuchi
2011/0031070 A1 2/2011 Gerstenkorn et al.
2011/0035604 A1 2/2011 Habraken
2011/0048865 A1 3/2011 Flynn et al.
2011/0132699 A1 6/2011 Tokura et al.
2011/0209950 A1 9/2011 Hakala et al.
2012/0037461 A1 2/2012 Finschi
2015/0217969 A1 * 8/2015 Flynn ..... B66B 1/468 187/380

FOREIGN PATENT DOCUMENTS

JP 2011153002 8/2011
KR 102010010273 9/2010
WO 2010069347 6/2010
WO 2011141627 11/2011

OTHER PUBLICATIONS

International Preliminary Report on Patentability for International application No. PCT/US2012/043696 dated Dec. 31, 2014.
Examination Report under Section 18(3) for GB Application No. GB1500979.8, dated Jun. 20, 2017.

* cited by examiner

SYSTEM AND METHOD FOR CONTROLLING ELEVATOR SYSTEM ACCESS

BACKGROUND

Elevator systems are in widespread use for carrying passengers among various levels within buildings. Elevator systems traditionally have included hall call buttons that allow an elevator passenger to provide an indication of a desired direction of travel when placing an elevator call. Once an elevator car is available at the location where the call was placed, the passenger enters the elevator car and uses a car operating panel to provide an indication of the passenger's desired destination. Such systems have proven useful and reliable for many years.

More recently, different elevator system configurations have been introduced that allow passengers to indicate a desired destination from outside of an elevator car. Some such systems include a kiosk or passenger interface in a lobby. Passengers can enter desired destinations using the kiosk. The elevator system determines which car to assign to each passenger request and provides an indication to the passenger of the assigned elevator car. A variety of configurations of such systems have been proposed for communicating the passenger's intended destination and for communicating information to the passenger so that they board the correct elevator car.

One limitation of such systems is that the passenger typically has to remember which elevator car to board and there may be some time between the passenger learning that information and actually boarding the elevator car. Another drawback associated with such systems is that they provide limited security over who can board an elevator car. There are situations, for example, where elevator system access should be limited for security reasons.

SUMMARY

An exemplary method of controlling elevator system access includes receiving a request from a portable wireless communication device indicating a desire for at least access to an elevator car. An indication of an access credential is provided to the portable wireless communication device if the request satisfies a selected criterion. The access credential at least temporarily indicates that the desired access should be granted. The desired access is granted responsive to receiving the provided access credential from the portable wireless communication device.

An exemplary method of obtaining access to an elevator system includes transmitting a request from a portable wireless communication device indicating a desire for at least access to an elevator car. An indication of an access credential is received at the portable wireless communication device. The access credential at least temporarily indicates that the desired access should be granted. The received access credential is provided from the portable wireless communication device to a credential receiver to obtain the desired access.

An exemplary elevator system includes at least one elevator car. An access controller is configured to provide an access credential to a portable wireless communication device responsive to a request from that device indicating a desire for at least access to the elevator car. The access credential at least temporarily indicates that the desired access should be granted. A credential receiver is configured to obtain the provided access credential from the portable wireless communication device. An entry device allows the desired access responsive to the credential receiver obtaining the access credential.

The various features and advantages of disclosed example embodiments will become apparent to those skilled in the art from the following detailed description. The drawings that accompany the detailed description can be briefly described as follows.

DETAILED DESCRIPTION

Figure 1:
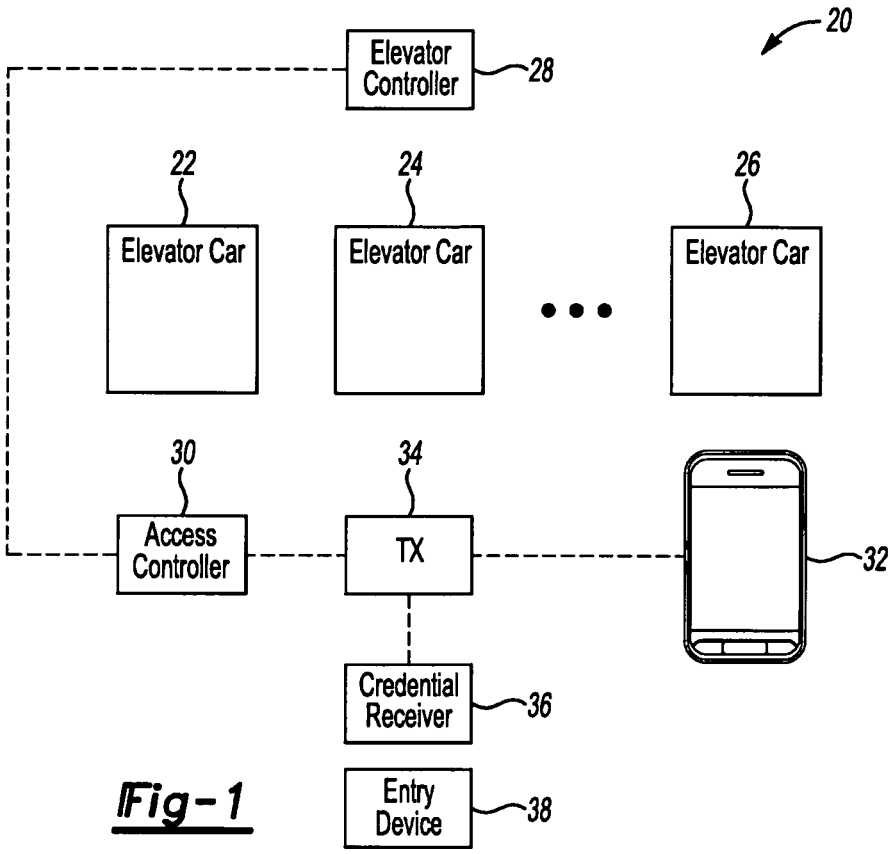
FIG. 1 schematically illustrates selected portions of an elevator system designed according to an embodiment of this invention.

FIG. 1 schematically shows selected portions of an elevator system 20. A plurality of elevator cars 22, 24 and 26 are situated in a known manner for carrying passengers to various levels within a building. Although three elevator cars are illustrated, any number of elevator cars may be included in an elevator system designed according to an embodiment of this invention.

An elevator controller 28 controls operation of the elevator cars 22, 24 and 26. The elevator controller 28 uses known dispatching algorithms for assigning one of the elevator cars to a passenger request for elevator service. The elevator controller 28 in this example also controls whether an elevator car will be accessible by an individual using techniques such as controlling whether one of the elevator cars is assigned to carry that individual to a desired destination or controlling whether the elevator car doors will be opened for an individual.

An access controller 30 controls whether an individual will be granted access to the elevator system. The access controller 30 in this example is configured to also control whether an individual will be granted access to a building or a restricted area within a building. The access controller is configured to communicate with a portable wireless communication device 32. In the illustrated example, the access controller 30 has an associated transceiver 34 that wirelessly communicates with the portable wireless communication device 32.

In one example, the portable wireless communication device 32 is a mobile station configured for telecommunication. In one example, the mobile station comprises a smart phone. In another example the device 32 is a tablet or another mobile device. In this example, the portable wireless communication device 32 comprises a smart phone that includes a software application enabling it to communicate with the access controller 30.

An elevator passenger uses the wireless communication device 32 to provide a request indicating a desire for access to the elevator system. In one example, the request includes an indication of a desired destination of the elevator passenger. The access controller 30 receives the request from the wireless communication device 32. If the request satisfies a selected criterion, such as originating from a recognized wireless communication device 32 or including an identifier of an authorized elevator passenger with the request, the access controller 30 provides an indication of an access credential to the wireless communication device 32. That access credential is then provided by the wireless communication device 32 to a credential receiver 36. For example, the wireless communication device 32 displays the access credential as a bar code or a scan code and the credential receiver 36 comprises a scanner or reader. When a valid access credential is received, the desired access indicated in the request is granted.

In the example of FIG. 1, an entry device 38 controls whether an elevator passenger is provided with the desired access. The entry device 38 may be a turnstile, for example, to control whether an individual is allowed to enter a building, elevator lobby or a restricted area within a building. In such an example, the request indicates a desire to enter a building or lobby. The illustrated example allows for integrating multiple security or access functions with elevator system features.

In some examples, the access credential has a limited time within which it is valid. Providing a temporary access credential to the wireless communication device 32 provides enhanced security over access to the elevator system or other portions of a building. A security pass card, for example, may be misplaced by an individual or stolen, leaving it vulnerable to use by an unauthorized individual. Printed barcodes may be copied, misplaced or stolen. Requiring that the wireless communication device 32 receive an access credential for purposes of granting access, therefore, provides enhanced security features compared to previous arrangements.

Figure 2:
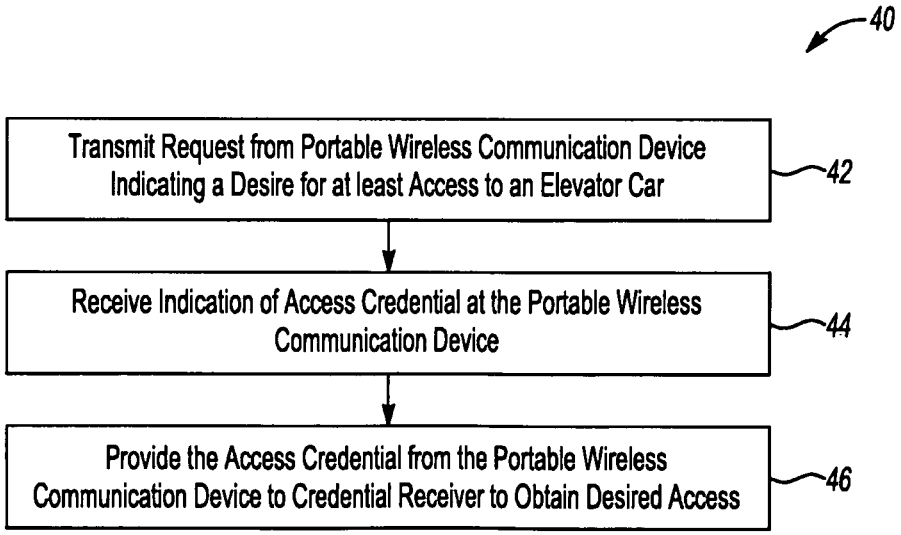
FIG. 2 is a flowchart diagram summarizing an example approach for obtaining access to an elevator system.

FIG. 2 includes a flowchart diagram 40 that summarizes an example approach for obtaining access to the elevator system 20. In this example, the wireless communication device 32 is within communication range of the transceiver 34. A user opens an application to attempt to gain access to the elevator system. At 42, the wireless communication device 32 transmits a request indicating a desire for at least access to an elevator car. The request may be manually initiated by user input or automatically initiated once the associated application is open. The request in some examples includes an indication of the desired destination of the elevator passenger. At 44, the wireless communication device 32 receives an indication of the access credential. At 46, the wireless communication device 32 provides the received access credential to the credential receiver 36 for obtaining the desired access.

Figure 3:
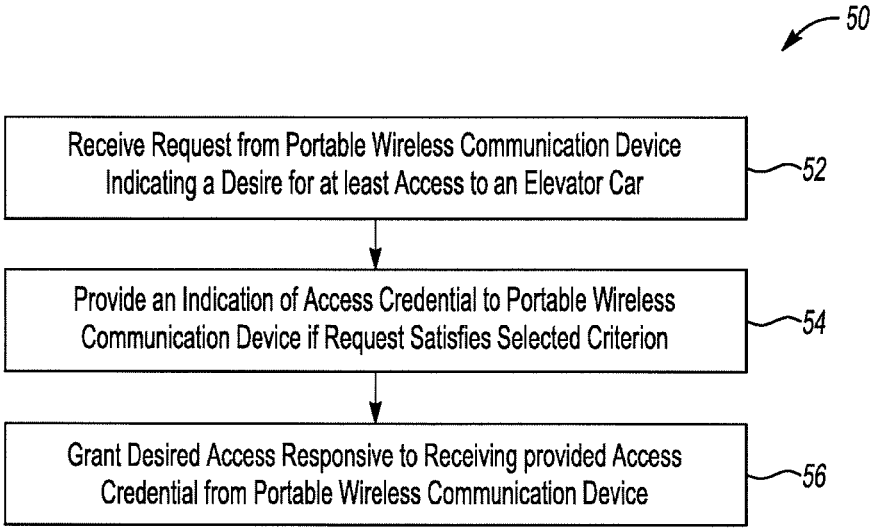
FIG. 3 is a flowchart diagram summarizing an example approach to controlling access to an elevator system.

FIG. 3 includes a flowchart diagram 50 summarizing an example approach for controlling access to an elevator system. At 52, the access controller 30 receives a request from the portable wireless communication device 32. The request indicates a desire at least for accessing the elevator system. The request in some examples includes an indication of the desired destination of the elevator passenger. At 54, the access controller 30 provides an indication of an access credential to the wireless communication device 32 if the received request satisfies a selected criterion. For example, the access controller 30 verifies that the request originates from an authorized device or includes an ID of an authorized user. At 56, the desired access is granted responsive to receiving the provided access credential at the credential receiver 36 from the wireless communication device 32.

Figure 4:
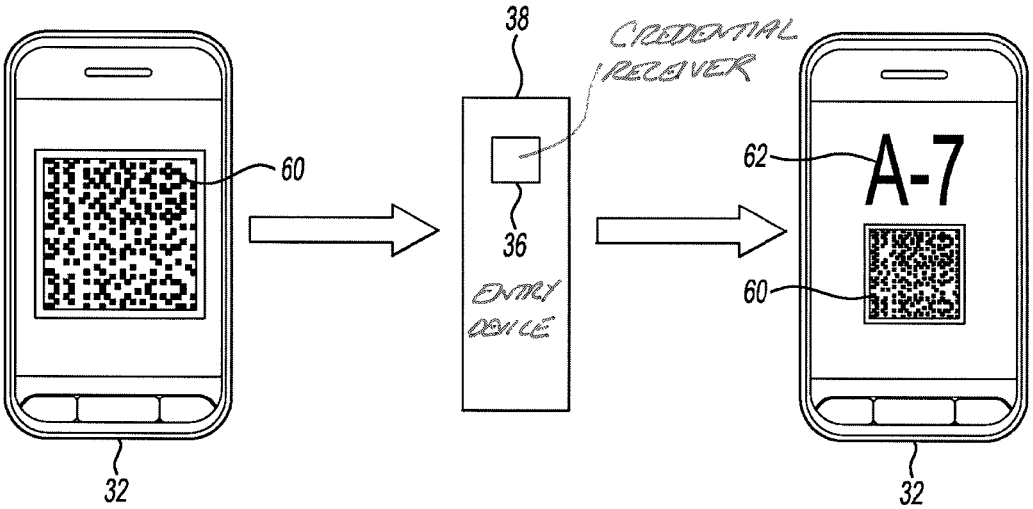
FIG. 4 schematically illustrates a procedure for obtaining and granting access to an elevator system.

FIG. 4 schematically illustrates an example communication session for providing access and elevator service. On the left hand side of FIG. 4, the wireless communication device 32, which comprises a smart phone in this example, displays an image 60 corresponding to the access credential received from the access controller 30. The elevator passenger holds the displayed image 60 where it can be detected by the credential receiver 36. In this example, the credential receiver 36 is mounted as part of a building entry turnstile 38. When a valid access credential is received, the entry device or turnstile 38 allows the individual to enter the building or area.

As shown on the right side of FIG. 4, the wireless communication device 32 displays an image 62 that indicates an elevator car assigned to carry the passenger to the desired destination. In some examples the indication of the assigned elevator car may include an audible indication.

As mentioned above, the passenger's intended destination may be communicated to the elevator system along with the request for desired access. In some examples, the passenger destination is communicated to the elevator system in a separate transmission from the wireless communication device 32. In still other examples the intended destination of the passenger is communicated to the elevator system as part of the communication of the access credential from the wireless communication device 32.

Some example implementations include a wireless communication device 32 that is configured for near field communications. For example, a smart phone may include a near field communication module that allows for using known near field communication protocol for securely communicating information between the device 32 and the access controller 30. The near field communication may be used for communicating the request for desired access, the passenger's intended destination, the provided access credential, or a combination of two or more of those.

One feature of using near field communications is that identification information regarding an elevator passenger may be prestored on the wireless communication device 32 so that it can be securely communicated to the access controller 30 when needed. In some examples, the identification information regarding the elevator passenger may be dynamically generated responsive to signals from the access controller. One feature of using a near field communication module is that it allows an individual to control the information that the module retains in memory for purposes of communicating with an access controller 30 in one or more buildings.

Another feature of near field communication techniques is that they allow for an active mode of communication in which the wireless communication device 32 uses its own power supply. This does not require an electro-magnetic coupling with the access controller or credential receiver. Near field communication techniques, therefore, are considered superior to RFID-based communication of the type of information exchanged between the wireless communication device 32 and the access controller 30.

In one example, a personal identification code entry functionality provides additional security. Upon entering a building the user opens the elevator access application on the portable wireless communication device 32. When opened or initialized, the application in one example automatically submits a request for a default destination floor. In another example, the first action of the application is to present a list of primary floors to the user for selection or presents a key pad or other selectors for allowing the user to enter a desired destination. In the event that the intended destination is a secure floor some identification of the user is required before the request will be serviced.

In one example an identification of the device 32 serves as the personal identification code. In another example, the user is prompted by the application on the device 32 to enter a secure personal identification code. Once the identification code is verified, the desired elevator service will be provided.

One feature of some example implementations is that each building has a unique system for communicating with mobile communication devices 32. Building or system identification information allows the elevator access application on the communication device 32 to customize the information provided to the user or to customize how the application performs upon establishing a communication with that particular system in a particular building. For example, the default floor for a user in one building (e.g., a workplace) will be different than the default floor for the same user in another building (e.g., another workplace building or a residential building). Additionally, the application will perform differently depending on the configuration of the system with which the device 32 is communicating to accommodate any special security features or to require more or less manual input from the user.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling elevator system access, comprising the steps of:

receiving a request from a portable wireless communication device indicating a desire for at least access to the elevator system;

providing an indication of an access credential to the portable wireless communication device if the request satisfies a selected criterion, the access credential at least temporarily indicating that the desired access should be granted; and granting the desired access responsive to receiving the provided access credential from the portable wireless communication device.

2. The method of claim 1, wherein the wireless communication device comprises a mobile station configured for telecommunication.

3. The method of claim 2, wherein the mobile station comprises a smart phone.

4. The method of claim 1, comprising receiving the access credential from the portable wireless communication device by detecting an image corresponding to the access credential displayed by the portable wireless communication device.

5. The method of claim 1, wherein the request indicates a desire for access to one of a building entry point or a restricted area within a building.

6. The method of claim 1, comprising receiving an indication of a desired destination of an elevator passenger with at least one of the received request or the received access credential;

assigning an elevator car to carry the passenger to the desired destination; and providing an indication of the assigned elevator car to the portable wireless communication device.

7. The method of claim 1, comprising communicating with the portable wireless communication device using near field communications.

8. The method of claim 1, wherein the access credential has a limited time during which the access credential is valid and granting the desired access only within the limited time.

9. A method of obtaining access to an elevator system, comprising the steps of:

transmitting a request from a portable wireless communication device indicating a desire for at least access to the elevator system;

receiving an indication of an access credential at the portable wireless communication device, the access credential at least temporarily indicating that the desired access should be granted; and providing the received access credential from the portable wireless communication device to a credential receiver to obtain the desired access.

10. The method of claim 9, wherein the wireless communication device comprises a mobile station configured for telecommunication.

11. The method of claim 10, wherein the mobile station comprises a smart phone.

12. The method of claim 9, comprising providing the access credential from the portable wireless communication device by generating an image by the portable wireless communication device, the image corresponding to the access credential.

13. The method of claim 9, wherein the request indicates a desire for access to one of a building entry point or a restricted area within a building.

14. The method of claim 9, comprising providing an indication of a desired destination of an elevator passenger with at least one of the request or the access credential;

receiving an indication of an assigned elevator car at the portable wireless communication device, the assigned elevator car being assigned to carry the elevator passenger to the desired destination; and providing an indication of the assigned elevator car to the elevator passenger from the portable wireless communication device.

15. The method of claim 9, comprising communicating at least one of the request or the access credential from the portable wireless communication device using near field communications.

16. The method of claim 9, wherein the access credential has a limited time during which the access credential is valid.

17. An elevator system, comprising:

at least one elevator car;

an access controller configured to provide an access credential to a portable wireless communication device responsive to a request from the portable wireless communication device indicating a desire for at least access to the elevator system, the access credential at least temporarily indicating that the desired access should be granted;

a credential receiver configured to obtain the provided access credential from the portable wireless communication device; and an entry device that allows the desired access responsive to the credential receiver obtaining the access credential.

18. The elevator system of claim 17, wherein the wireless communication device comprises a mobile station configured for telecommunication.

19. The elevator system of claim 18, wherein the mobile station comprises a smart phone.

20. The elevator system of claim 17, wherein the credential receiver is configured to receive the access credential from the portable wireless communication device by detecting an image corresponding to the access credential displayed by the portable wireless communication device.

21. The elevator system of claim 17, wherein the request indicates a desire for access to one of a building entry point or a restricted area within a building.

22. The elevator system of claim 17, wherein at least one of the request or the received access credential includes an indication of a desired destination of an elevator passenger;

an elevator controller assigns an elevator car to carry the passenger to the desired destination; and at least one of the access controller or the credential receiver provides an indication of the assigned elevator car to the portable wireless communication device.

23. The elevator system of claim 17, wherein at least one of the access controller or the credential receiver is configured to communicate with the portable wireless communication device using near field communications.

24. The elevator system of claim 17, wherein the access credential has a limited time during which the access credential is valid.

* * * * *